US006964225B2

(12) United States Patent
Gubler et al.

(10) Patent No.: US 6,964,225 B2
(45) Date of Patent: Nov. 15, 2005

(54) PRESS

(75) Inventors: Hans-Rudolf Gubler, Gebensdorf (CH); Johannes Haack, Studen (CH); Ernst Rytz, Suberg (CH)

(73) Assignee: Feintool International Holding AG, Lyss (CH)

( * ) Notice: Subject to any disclaimer, the term of this patent is extended or adjusted under 35 U.S.C. 154(b) by 75 days.

(21) Appl. No.: 10/203,063

(22) PCT Filed: Jan. 11, 2001

(86) PCT No.: PCT/EP01/00256

§ 371 (c)(1),
(2), (4) Date: Aug. 2, 2002

(87) PCT Pub. No.: WO01/56776

PCT Pub. Date: Aug. 9, 2001

(65) Prior Publication Data

US 2003/0015017 A1 Jan. 23, 2003

(30) Foreign Application Priority Data

Feb. 4, 2000 (DE) ..... 100 05 023

(51) Int. Cl.[7] ..... B30B 1/32; B26D 7/27

(52) U.S. Cl. ..... 100/214; 100/269.01; 83/615; 83/639.5

(58) Field of Search ..... 100/214, 259, 100/254, 258 R, 269.01, 270, 244, 257, 94, 95; 83/137, 615, 639.5, 639.1; 72/351, 417, 418, 453.13

(56) References Cited

U.S. PATENT DOCUMENTS

| | | | | | |
|---|---|---|---|---|---|
| 3,802,310 | A | * | 4/1974 | Maurer | 83/527 |
| 4,192,414 | A | * | 3/1980 | Baltschun | 192/129 R |
| 4,203,359 | A | * | 5/1980 | Baltschun | 100/209 |
| 4,890,475 | A | * | 1/1990 | Baltschun | 72/455 |
| 5,054,353 | A | * | 10/1991 | Haack et al. | 83/639.5 |
| 5,749,279 | A | * | 5/1998 | Gardner | 83/639.1 |
| 6,240,818 | B1 | * | 6/2001 | Baltschun | 83/137 |

FOREIGN PATENT DOCUMENTS

DE WO 01/00396 A2 * 1/2001

* cited by examiner

*Primary Examiner*—Derris H. Banks
*Assistant Examiner*—Jimmy Nguyen
(74) *Attorney, Agent, or Firm*—Bachman & LaPointe, P.C.

(57) ABSTRACT

A press, especially a precision cutting press, for producing precision cut parts from a metal strip or a preform by means of a tool, which is fixed to a top tool clamping plate and a bottom tool clamping plate, wherein a tappet is allocated to one of the tool clamping plates. The tappet is supported against an element fixed to the machine by means of at least one tappet drive piston unit, which is fixedly connected to an opposite element that is also fixed to the machine by means of at least two guide columns, the other tool clamping plate being disposed in said element, whereby the tappet can be displaced along the guide column.

14 Claims, 1 Drawing Sheet

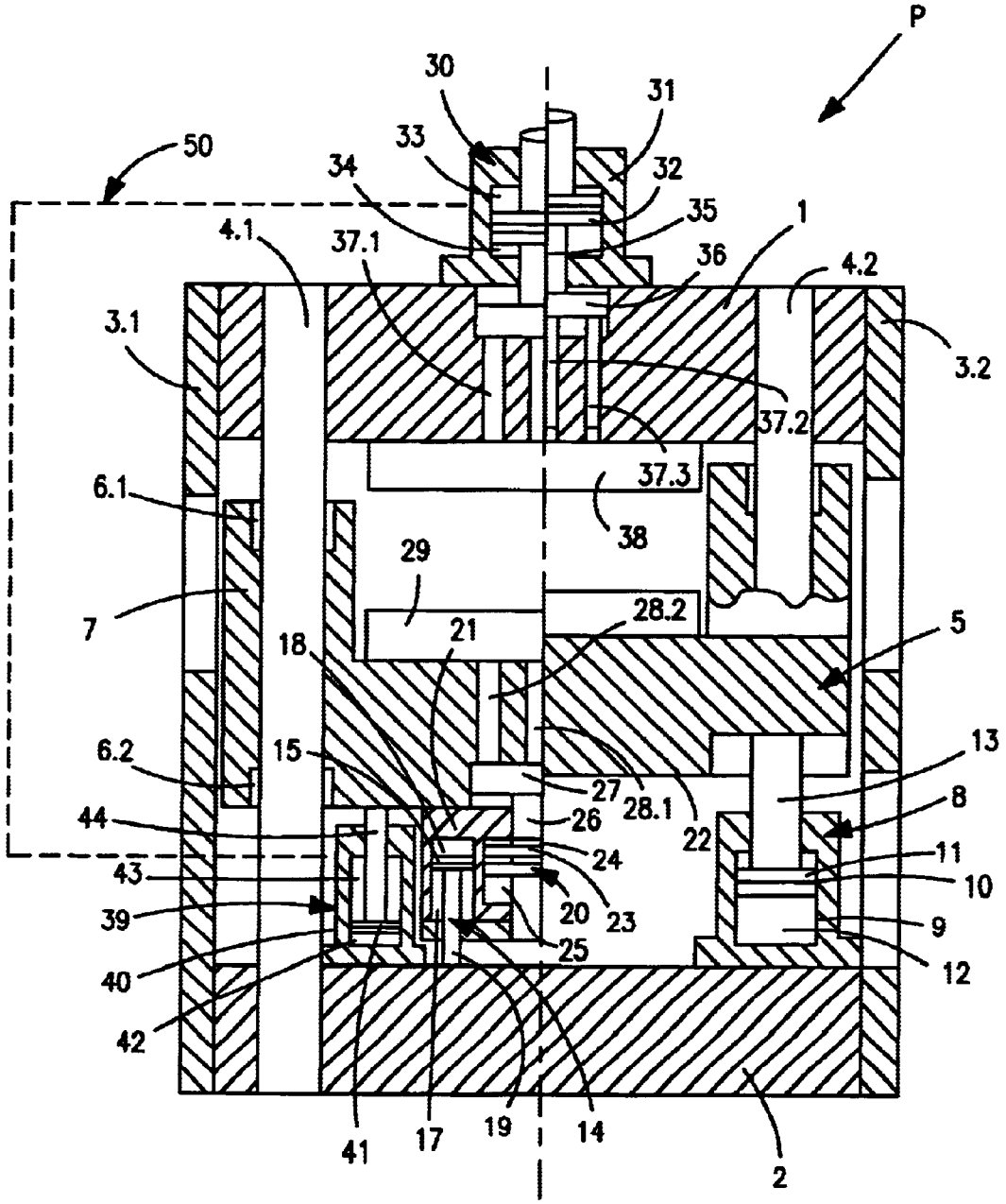
P
30
31
33
32
50
34
35
1
4.1
37.1
36
4.2
3.1
3.2
37.2
37.3
6.1
38
29
7
28.2
21
5
18
13
6.2
15
27
28.1
8
44
26
22
24
11
43
10
39
20
23
9
25
40
12
42
41
17
19
14
2

PRESS

BACKGROUND OF THE INVENTION

The invention relates to a press, in particular a fine-blanking press for producing fine-blanked parts from a metal strip or preforming by means of a tool which is fastened to a top tool-mounting plate and a bottom tool-mounting plate, a ram being assigned in each case to one of the tool-mounting plates.

Such a press has been disclosed, for example, by DE 196 42 635 A1. There, the ram is connected with little play to the guide pillars and is moved by the latter from an open position into a closed position. In this case, considerable masses are to be moved; furthermore, tilting of the ram may occur, which reduces the service life of the press and tools.

The object of the present invention is to develop a press of the above-mentioned type in which press elements forming the rigidity and the guide of the ram are uncoupled and no transverse forces or moments act on the guide.

SUMMARY OF THE INVENTION

The foregoing object is achieved by a press wherein the ram is supported via at least one ram-drive piston unit against an element which is fixed to the machine and which is firmly connected via at least two guide pillars to an opposite element which is likewise fixed to the machine and on which the other tool-mounting plate is arranged, the ram being displaceable along the guide pillar.

In this press concept, the outer press frame absorbs the static and dynamic forces of the system, but performs no ram guidance task. This results in an extremely rigid system in which, even during extremely concentric and eccentric loading, transverse forces and moments from the press frame have no effect on the ram guidance, a factor which has an extremely positive effect on the ram guidance and the tool life.

Two synchronously working ram-drive piston units are preferably provided, by means of which the four movements "quick closing, feeling, blanking/forming, quick return" are carried out. This involves clamped, double-acting cylinders. Rapid-traverse cylinders as used in known presses are no longer necessary.

The ram guidance is preferably effected with two to four guide pillars in the corner regions of the press. The guide pillars primarily serve to guide the ram and absorb only tilting moments from the stress on the tools. In the limit regions of the press load, the guide pillars if need be perform a tie rod function. The actual press body is formed from a top and a bottom yoke and by machine frame plates, four machine frame plates being provided as a rule, these machine frame plates still having openings for stamping-strip feeding and discharge, tool-space operation and parts removal or installation openings. This results in a compact press in which control of the static and dynamic stresses is taken care of by the press body and the ram guide tasks are assigned to the guide pillars.

The ram guidance itself is effected via at least two spaced-apart guide bushes. In order to arrange them, the walls of the ram are preferably raised laterally, so that the actual working region of the tool lies between the two guide bushes. This achieves the effect that a neutral zone in terms of movement is produced in the working region of the tool, so that tilting of the ram has no adverse effects on the active elements of the tool.

Provided the press is a fine-blanking press, a V-ring cylinder unit is to be assigned to the one yoke. This V-ring cylinder unit normally sits in or at the top on the top yoke, the cylinder in turn being a double-acting cylinder with circulation.

The pressure force which acts on a corresponding piston is transmitted into the tool space via pressure pins and pressure plates which likewise sit in the yoke.

During the working travel, pressure fluid is displaced from the corresponding pressure space of the V-ring cylinder unit by means of the pressure pins and the pressure plate. This pressure fluid is transmitted to preferably four compensation pistons which are disposed on the bottom yoke and whose piston rods act on the underside of the ram. As a result, the ram drive force is assisted and the displacement work of the V-ring function is compensated for and need no longer be subtracted from the total force as in the known presses. Presses of this type of construction therefore have a useful press force about 30% higher at the same overall size. The displacement volume of the V-ring cylinder unit preferably corresponds to the volume of the compensation pistons.

Assigned to the ram itself is a counterholding-force cylinder unit, in which the cylinder is again a double-acting cylinder with circulation. The counterholding-force cylinder unit or its cylinder sits in or under the ram. Here, too, the force of the piston is transmitted into the tool space through the ram via pressure pins and pressure plates.

When the counterholding-force cylinder unit is working, the displaced pressure fluid, in a similar manner to the V-ring cylinder unit, is preferably directed to two to three compensation pistons which are preferably integrated in the cylinder of the counterholding-force cylinder unit and whose piston rods are supported against the bottom yoke. As a result, the displacement work of the counterholding-force function is compensated for and the ram drive force is assisted. Here, too, the displacement volume approximately corresponds to the volume of the compensation pistons. The displacement work of the counterholding-force function therefore no longer has to be subtracted from the total force of the press in this application either. Presses of this type of construction therefore have an overall useful press force about 40% higher than presses of known type of construction.

The V-ring cylinder unit and the counterholding-force cylinder unit, both as far as the force and thus the pressure are concerned and also with regard to the travel, can preferably be adjusted independently of one another.

This also ensures a controlled and/or regulated ram speed freely selectable at every operating point and thus ensures optimum quality of parts with at the same time optimum service life of the active elements of the tools.

Since the ram movements of the press according to the invention are only carried out by means of the ram-drive piston units, whereby the rapid-closing and rapid-return cylinders are dispensed with, any desired travel/time characteristic which corresponds to the capacity of the ram-drive piston units can be run over a stroke (ram cycle BDC-TDC-BDC). Since the "shakehands", related to the control, between actuators and sensors of the ram drive and the rapid-traverse cylinder functions in the control are thereby dispensed with, the ram cycle time can be improved, which leads to higher production quantities and optimum tool life.

BRIEF DESCRIPTION OF THE DRAWINGS

Further advantages, features and details of the invention follow from the description below of preferred exemplary embodiments and with reference to the drawing which shows a cross section through a press according to the invention, an open position being shown in half section on the left side and a closed position being shown in half section on the right side.

DETAILED DESCRIPTION

The press P according to the invention has a flexurally rigid top yoke 1 and a flexurally rigid bottom yoke 2. The top yoke 1 and bottom yoke 2 are firmly connected on the outside by machine frame plates 3.1 and 3.2 and form the press column.

Furthermore, the top yoke 1 and the bottom yoke 2 are connected to one another via guide pillars 4.1 and 4.2, four guide pillars preferably being provided in the corner regions of the press. The connection to the guide pillars 4.1 and 4.2 may be fixed or mounted in an articulated manner as a tie rod.

A ram 5 is guided on the guide pillars 4.1 and 4.2, this ram 5 having two spaced-apart guide bushes 6.1 and 6.2 per guide pillar. For this purpose, parts 7 of the ram 5 are also designed to be extended, so that a relatively large spacing of the guide bushes 6.1 and 6.2 is ensured.

The ram 5 is driven by a ram-drive piston unit 8. Two ram-drive piston units 8 are preferably provided, which act as symmetrically as possible on the ram 5. In the exemplary embodiment, however, only one ram-drive piston unit 8 is shown.

The ram-drive piston unit 8 is a double-acting preloaded cylinder 9 with circulation, a piston 10 separating two pressure spaces 11 and 12 from one another in said cylinder 9. A piston rod 13, which is connected to the ram 5, leads out of the cylinder 9.

Furthermore, a counterholding-force cylinder unit 20 is assigned to the ram 5.

The counterholding-force cylinder unit 20 has a cylinder 21 which sits on an underside 22 of the ram 5. In the cylinder 21, a piston 23 again separates two pressure spaces 24 and 25 from one another, while a piston rod 26 leads out of the cylinder 21 from the piston 23 and is connected via pressure plates 27 to pressure pins 28.1 and 28.2. These pressure pins 28.1 and 28.2 pass through the ram 5 and also through a tool-mounting plate 29 and engage in a bottom tool (not shown in any more detail), where they support a counterholder, as is known in the case of a fine-blanking tool.

Via a fluid connection (not shown in any more detail), the counterholding-force cylinder unit 20 is connected to a compensation piston 14. Its piston 15 sits in the cylinder 21 and, here too, again separates two pressure spaces 17 and 18 from one another. Hose connections can be dispensed with due to the integration in the cylinder 21.

Connected to the piston 15 is a push rod 19 which supports the cylinder 21 of the counterholding-force cylinder unit 20 and is supported against the bottom yoke 2.

A V-ring cylinder unit 30 sits on the top yoke 1. In the corresponding cylinder 31, a piston 32 separates two working spaces 33 and 34 from one another.

A piston rod 35 leads from the piston 32 to a pressure plate 36, which in turn is connected via pressure pins 37.1, 37.2 and 37.3, after passing through a tool-mounting plate 38, to a V-ring plate of a tool (not shown in any more detail), as is likewise known from the prior art.

The V-ring cylinder unit 30 is fluidically connected to at least one further compensation piston 39 by fluid line 50 which sits on the bottom yoke 2 with a corresponding cylinder housing 40. A piston 41 again separates two working spaces 42 and 43, a piston rod 44 connected to the piston 41 leading out of the cylinder 40 and being connected to the underside 22 of the ram 5.

The mode of operation of the present invention is as follows:

A tool, as shown, for example, in "Feinscheiden", Handbuch für die Praxis, 2nd edition, 1977, pages 85 ff., essentially comprises a top tool part and a bottom tool part. The top tool part has a rear V-ring plate with a V-ring which encloses a fixed blanking punch. Assigned opposite the blanking punch in the bottom tool part is a flexible ejector (counterholder) which in turn is enclosed by a fixed die plate.

During a ram stroke (working cycle), in the course of which the top or the bottom tool part can be connected to the ram, the V-ring penetrates into the material of a punching strip and encloses the part to be cut out. After the penetration, the workpiece to be cut out is clamped in place between punch and ejector (counterholder). In this clamped state, the ram force now begins to cut out the workpiece, the V-ring plate at the same time being displaced back against the V-ring force, and the ejector being displaced against the counterholding force into the die by the material thickness of the workpiece. After the blanking operation has been carried out, during which the workpiece to be cut out is cut out of the punching strip and pushed into the die plate by the blanking punch, the V-ring force and the counterholding force are removed. The total force of the press in order to cut out the workpiece is therefore made up as follows:

$$F_{total}=F_{blanking}+F_{V\text{-}ring}+F_{counterholder}$$

Such a tool is preferably assembled outside the press on tool change plates 29, 38 and pushed into the machine via cantilever beams. This is shown, for example, in WO97/35710. The cantilever beams are normally an integral part of the machine.

The tool change plates 29, 38 are positioned via hydraulically actuated centering pins and clamped hydraulically via draw-in or swivel draw-in clamps. This operation can be started in a semiautomatic or fully automatic manner via the press control.

One possibility of fastening a tool to the two tool change plates 29 and 38 is shown, for example, in U.S Pat. No. 4,718, 339.

After the insertion of the tool pack and after the semiautomatic or fully automatic input of all tool- and workpiece-dependent process parameters, the semiautomatic or fully automatic punching operation can be started.

For a ram stroke nowadays, according to the prior art, as shown, for example, in "Feinschneiden", Handbuch für die Praxis, 2nd edition, page 192, the V-ring cylinder and counterholder cylinder, in relation to the process, are set to the desired force by means of a pressure medium and are brought to a point just before material contact of the punching strip by means of quick-closing pistons of the ram. During this operation, a pressure medium is drawn or forced into the main working cylinder. After the inlet valve is closed, the pressure medium is compressed to the desired working pressure and thus the total force required is produced with the main working cylinder and the workpiece is cut out according to the sequence of operations described above.

In the press P according to the invention, the pressure spaces 11, 12; 17, 18; 24, 25; 33, 34; 42, 43 are under a process-related working pressure at the start of a ram stroke. The closing movement of the ram 5 is now initiated in the sense that, for example, the valve is opened toward the pressure space 11. Owing to the fact that pressure space 12 is still under the process-related working pressure, the closing movement starts immediately. By means of known physical laws, via the valve positions relative to the pressure spaces 11 and 12, respectively, any desired travel/time diagram or velocity diagram can be run within the limits of the installed capacity. Therefore, according to the invention, for the required ram movement and the required ram force, the pressure medium is not brought to the required pressure, but rather the pressure space (e.g. 11) is specifically relieved and the pressure medium is circulated as useful pressure medium into the pressure space 12.

According to the illustration, the ram 5, guided on the guide pillars 4.1, 4.2, travels upward. For example, as soon as there is a punching strip between the bottom and the top tool, the V-ring is pressed into the material of the punching strip. In the course of the blanking operation now commencing, the V-ring plate runs back and displaces the pressure pins 37.1 to 37.3 and the pressure plate 36 upward. As a result, the piston 32 is likewise pushed upward, and the pressure medium is displaced in the pressure space 33 at constant pressure. The pressure medium is displaced from the pressure space 33 into the pressure space 42 of the compensation pistons 39, so that the piston rod 44 is pressed against the underside 22 of the ram 5 and assists the ram drive force.

When the ejector or the counterholder gives way during the blanking operation, the pressure pins 28.1 and 28.2 and the pressure plate 27 are pressed downward by the workpiece thickness, as is the piston 23 of the counterholding-force cylinder unit 20. As a result, pressure medium is displaced from the pressure space 25 at constant pressure into the pressure space 18 of the compensation pistons 14, so that the push rod 19 presses against the bottom yoke 2 and likewise assists the ram drive force. In this case, the displacement volume of the V-ring cylinder unit and of the counterforce cylinder unit 20 in each case corresponds to the volume of the respective compensation pistons 14 and 39.

As a result, the forces for the V-ring function and counterholder function are compensated for via the hydraulic pressure conversion. The press therefore only has to apply the blanking force and less percentage loss as total force.

$$F_{total}=F_{blanking}+F_{losses}$$

A press P according to the invention can therefore fine-blank an analogous workpiece with about 40% of the capacity.

The machine is of course fitted with all possible automation components, such as, for example, inlet feed and outlet feed for a punching strip, lubricating device, parts-feeding device, parts-transfer device, scrap-removal device, etc.

The machine can be set up at floor level and requires no foundation pit. Due to the compensation pistons 14 and 39 according to the invention, the energy balance overall is optimal.

List of Item Numbers

1 Top yoke
2 Bottom yoke
3 Machine frame plate
4 Guide pillar
5 Ram
6 Guide bush
7 Part
8 Ram-drive piston unit
9 Cylinder
10 Piston
11 Pressure space
12 Pressure space
13 Piston rod
14 Compensation piston
15 Piston
16
17 Pressure space
18 Pressure space
19 Push rod
20 Counterforce cylinder unit
21 Cylinder
22 Underside
23 Piston
24 Pressure space
25 Pressure space
26 Piston rod
27 Pressure plate
28 Pressure pin
29 Tool-mounting plate
30 V-ring cylinder unit
31 Cylinder
32 Piston
33 Pressure space
34 Pressure space
35 Piston rod
36 Pressure space
37 Pressure pin
38 Tool-mounting plate
39 Compensation piston
40 Cylinder housing
41 Piston
42 Pressure space
43 Pressure space
44 Piston rod
P Press

What is claimed is:

1. A press for producing fine-blanked parts from metal by means of a tool comprising a first tool-mounting plate (38) and a second tool-mounting plate (29), a ram (5) mounted to the second tool-mounting plate (29), wherein the ram (5) is movably supported via at least one ram-drive piston unit (8) on a first yoke (2) which is stationary and which is fixedly connected via at least two stationary guide pillars (4.1, 4.2) to a second stationary yoke (1), wherein the first yoke and the second yoke are further fixedly connected to one another by frame plates (3.1, 3.2) the first tool-mounting plate (38) is arranged on the second yoke (1), the ram (5) is movable along the two guide pillars (4.1, 4.2) by the at least one ram-drive piston unit (8), wherein the ram is further supported by a plurality of compensation pistons (39), and wherein a V-ring cylinder unit (30) is fixedly mounted to the second yoke.

2. The press as claimed in claim 1, wherein four guide pillars (4.1, 4.2) are provided in the corner regions of the press (P).

3. The press as claimed in claim 1, wherein the ram (5), with two spaced-apart guide bushes (6.1, 6.2), encloses the guide pillars (4.1, 4.2).

4. The press as claimed in claim 1, wherein four compensation pistons (39) are provided on the first yoke and are supported against the ram (5).

5. The press as claimed in claim 4, wherein the compensation pistons (39) are fluidically connected to the V-ring cylinder unit (30).

6. The press as claimed in claim 5, wherein the displacement volume of the V-ring cylinder unit (30) corresponds to the volume of the compensation pistons (39).

7. The press as claimed in claim 5, wherein a counterholding-force cylinder unit (20) is assigned to the ram (5).

8. The press as claimed in claim 7, wherein the counterholding-force cylinder unit (20) is arranged on the ram (5) between the ram-drive piston unit (8) and the compensation pistons (39).

9. The press as claimed in claim 8, wherein the counterholding-force cylinder unit (20) is supported against the first yoke (2) via at least one compensation piston (14).

10. The press as claimed in claim 9, wherein the counterholding-force cylinder unit (20) is fluidically connected to the compensation piston(s) (14).

11. The press as claimed in claim 10, wherein the displacement volume of the counterholding-force cylinder unit (20) corresponds to the volume of the compensation pistons (14).

12. The press as claimed in claim 11, wherein the displacement work of the V-ring unit and counterholding-force unit is utilized in compensation cylinders as useful force for blanking the fine-blanked parts.

13. The press as claimed in claim 12, wherein the V-ring cylinder unit (30) and the counterholding-force cylinder unit (20) can be adjusted independently of one another.

14. The press as claimed in claim 13, wherein the ram-drive piston units are designed as double-acting cylinder units with circulation of the pressure medium.

* * * * *